US005809901A

United States Patent [19]

Gutzmer

[11] Patent Number: 5,809,901

[45] Date of Patent: Sep. 22, 1998

[54] TABLE EDGE BUMPER ASSEMBLY

[76] Inventor: Carl Gutzmer, P.O. Box 366, Mandeville, Manchester, Jamaica

[21] Appl. No.: 596,599

[22] Filed: Feb. 5, 1996

[51] Int. Cl.[6] ..... A47B 17/00

[52] U.S. Cl. ..... 108/27; 52/716.3; 52/716.4; 52/800.18; 52/800.12; 52/656.9; 312/140.3; 312/140.4

[58] Field of Search ..... 108/27, 90; 312/140.1, 312/140.3, 140.4, 204; 52/716.3, 716.4, 782.2, 782.21, 782.22, 782.23, 782.24, 800.18, 800.1, 800.11, 800.12, 656.9; 248/345.1

[56] References Cited

U.S. PATENT DOCUMENTS

| | | | |
|---|---|---|---|
| 517,931 | 4/1894 | O'Meara | 52/782.21 X |
| 1,810,579 | 6/1931 | Schmitz | 52/782.22 |
| 2,092,441 | 9/1937 | Ciprus | 108/90 X |
| 2,237,840 | 4/1941 | Nelson et al. | 52/782.23 |
| 4,503,780 | 3/1985 | Apissomian | 248/345.1 X |
| 4,606,170 | 8/1986 | Mendenhall | 52/782.2 X |
| 5,253,932 | 10/1993 | Nesovic | 108/27 X |
| 5,440,857 | 8/1995 | Shanok et al. | 108/27 X |

*Primary Examiner*—Peter M. Cuomo
*Assistant Examiner*—Janet M. Wilkens

[57] ABSTRACT

A bumper assembly for covering peripheral edges of a table. The assembly includes linear bumpers securable to straight edges of a table. Corner bumpers extend between adjacent angled linear bumpers so as to protect an individual from impact against the table edges and corners. The bumpers are constructed of a substantially transparent material so as to permit viewing of the table edges therethrough.

12 Claims, 3 Drawing Sheets

TABLE EDGE BUMPER ASSEMBLY

BACKGROUND OF THE INVENTION

1. Field of the Invention

The present invention relates to furniture protectors and more particularly pertains to a table edge bumper assembly for covering peripheral edges of a table.

2. Description of the Prior Art

The use of furniture protectors is known in the prior art. More specifically, furniture protectors heretofore devised and utilized are known to consist basically of familiar, expected and obvious structural configurations, notwithstanding the myriad of designs encompassed by the crowded prior art which have been developed for the fulfillment of countless objectives and requirements.

Known prior art furniture protectors include U.S. Pat. 3,922,408; U.S. Pat. 5,149,575; U.S. Pat. 4,817,902; U.S. Pat. 4,117,782; U.S. Pat. 4,582,739; U.S. Pat. 4,810,550; U.S. Pat. 5,060,902; U.S. Pat. 5,065,972; and U.S. Pat. 5,322,257.

While these devices fulfill their respective, particular objectives and requirements, the aforementioned patents do not disclose a table edge bumper assembly for covering peripheral edges of a table which includes linear bumpers securable to straight edges of a table, and corner bumpers extending between adjacent angled linear bumpers so as to protect an individual from impact against the table edges and corners, wherein the bumpers are constructed of a substantially transparent material so as to permit viewing of the table edges therethrough.

In these respects, the table edge bumper assembly according to the present invention substantially departs from the conventional concepts and designs of the prior art, and in so doing provides an apparatus primarily developed for the purpose of covering peripheral edges of a table.

SUMMARY OF THE INVENTION

In view of the foregoing disadvantages inherent in the known types of furniture protectors now present in the prior art, the present invention provides a new table edge bumper assembly construction wherein the same can be utilized for covering peripheral edges of a table. As such, the general purpose of the present invention, which will be described subsequently in greater detail, is to provide a new table edge bumper assembly apparatus and method which has many of the advantages of the furniture protectors mentioned heretofore and many novel features that result in a table edge bumper assembly which is not anticipated, rendered obvious, suggested, or even implied by any of the prior art furniture protectors, either alone or in any combination thereof.

To attain this, the present invention generally comprises a bumper assembly for covering peripheral edges of a table. The inventive device includes linear bumpers securable to straight edges of a table. Corner bumpers extend between adjacent angled linear bumpers so as to protect an individual from impact against the table edges and corners. The bumpers are constructed of a substantially transparent material so as to permit viewing of the table edges therethrough.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new table edge bumper assembly apparatus and method which has many of the advantages of the furniture protectors mentioned heretofore and many novel features that result in a table edge bumper assembly which is not anticipated, rendered obvious, suggested, or even implied by any of the prior art furniture protectors, either alone or in any combination thereof.

It is another object of the present invention to provide a new table edge bumper assembly which may be easily and efficiently manufactured and marketed.

It is a further object of the present invention to provide a new table edge bumper assembly which is of a durable and reliable construction.

An even further object of the present invention is to provide a new table edge bumper assembly which is susceptible of a low cost of manufacture with regard to both materials and labor, and which accordingly is then susceptible of low prices of sale to the consuming public, thereby making such table edgebumper assemblies economically available to the buying public.

Still yet another object of the present invention is to provide a new table edge bumper assembly which provides in the apparatuses and methods of the prior art some of the advantages thereof, while simultaneously overcoming some of the disadvantages normally associated therewith.

Still another object of the present invention is to provide a new table edge bumper assembly for covering peripheral edges of a table.

Yet another object of the present invention is to provide a new table edge bumper assembly which includes linear bumpers securable to straight edges of a table, and corner bumpers extending between adjacent angled linear bumpers so as to protect an individual from impact against the table edges and corners, wherein the bumpers are constructed of a substantially material so as to permit viewing of the table edges therethrough.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
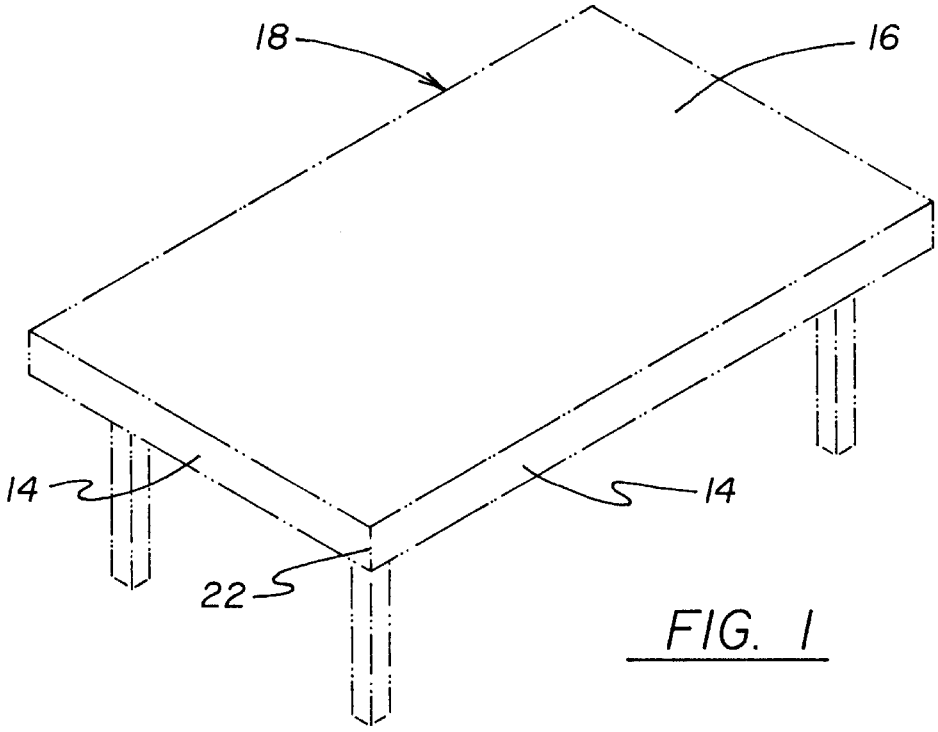
FIG. 1 is an isometric illustration of a table to which the present invention can be coupled.

With reference now to the drawings, and in particular to FIGS. 1–7 thereof, a new table edge bumper assembly embodying the principles and concepts of the present invention and generally designated by the reference numeral 10 will be described.

Figure 2:
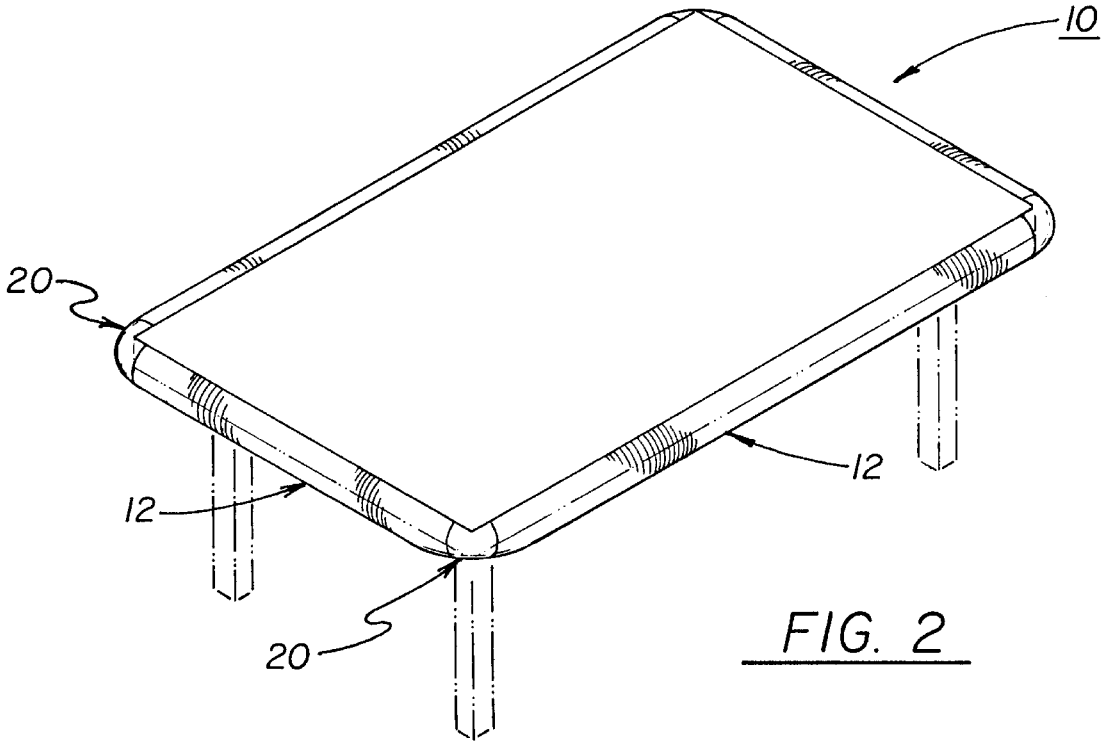
FIG. 2 is an isometric illustration of a table edge bumper assembly according to the present invention as coupled to the table.

More specifically, it will be noted that the table edge bumper assembly 10 comprises at least one linear bumper 12 securable to a linear outer peripheral edge 14 of a table top 16 of a table 18 such as is illustrated in FIGS. 1 and 2 of the drawings. At least one corner bumper member 20 is provided with the present invention 10 and is removably coupled to the linear bumper member 12 for covering a corner 22 of the table top 16. By this structure, the outer peripheral edges 14 and the corners 22 of the table top 16 are substantially covered so as to preclude injury to an individual or the table top 16 upon impacting of the individual against the table 18.

Figure 3:
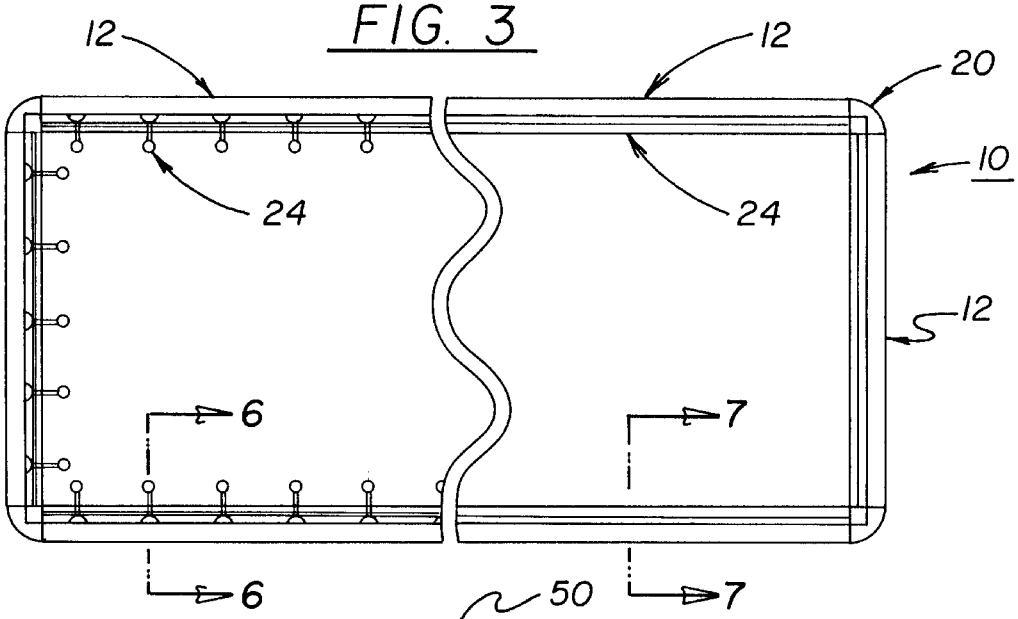
FIG. 3 is a top plan view of the invention in use illustrating various forms of a coupling means of the invention.
Figure 6:
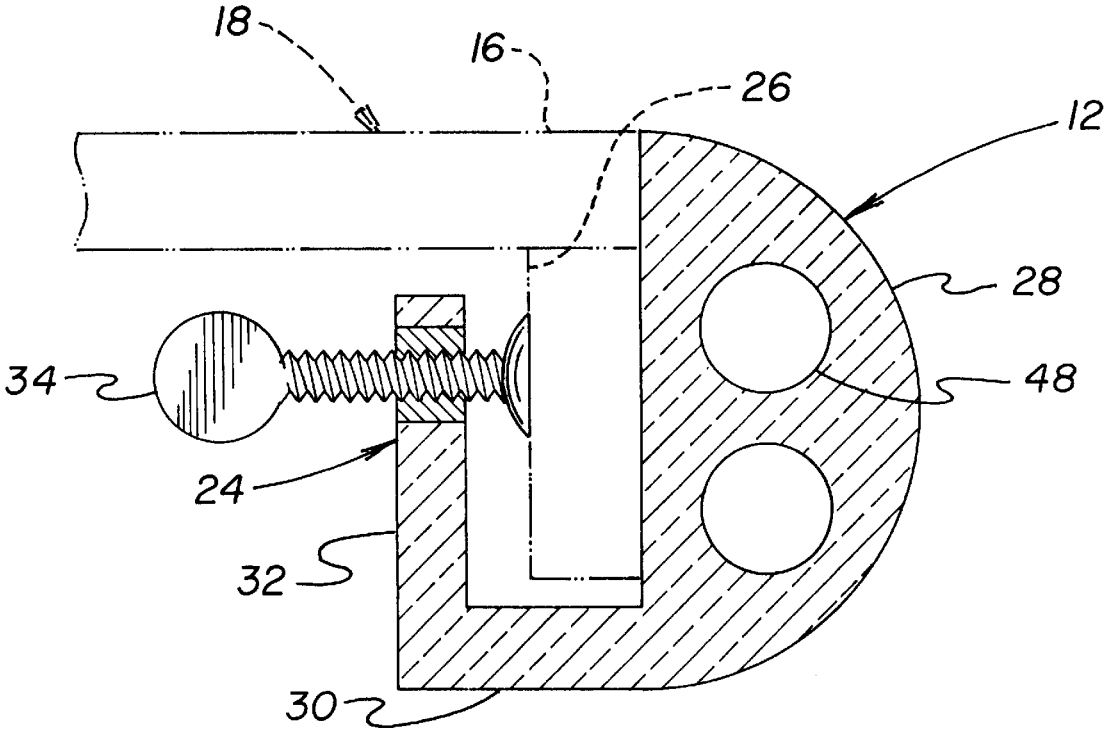
FIG. 6 is a cross sectional view taken along line 6—6 of FIG. 3.
Figure 7:
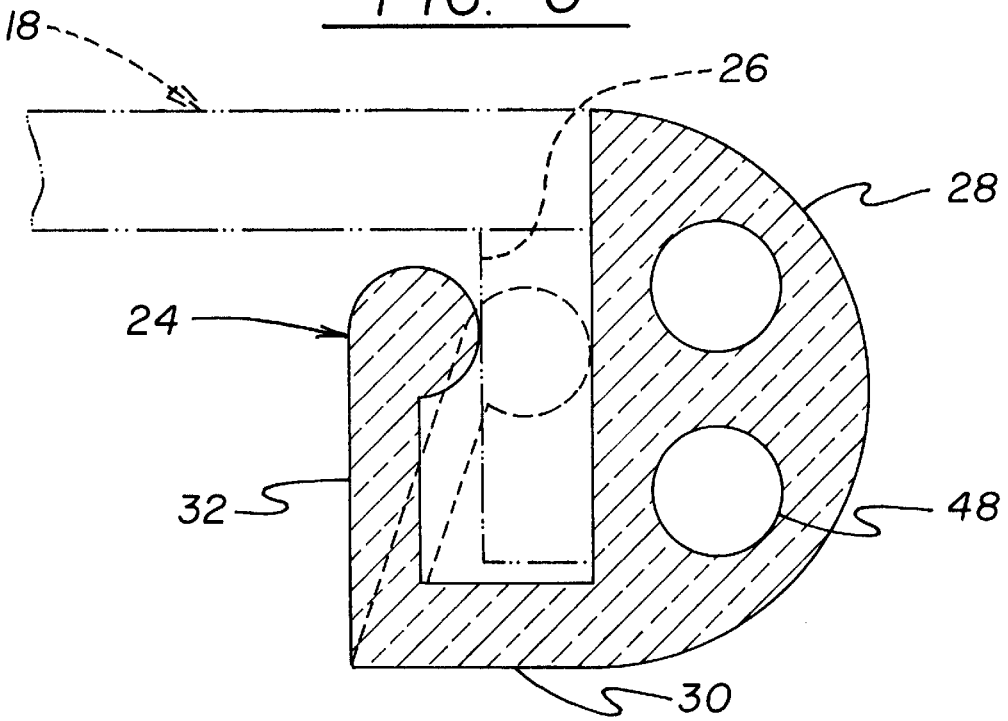
FIG. 7 is a cross sectional view taken along line 7—7 of FIG. 3.

Referring to FIG. 3 with concurrent reference to FIGS. 6 and 7, it can be shown that the linear bumper member 12 includes a coupling means 24 extending therefrom for engaging a depending flange 26 extending about the table top 16 of the table 18. A semi-cylindrical member 28 extends from the coupling means and includes an unlabeled arcuate exterior surface of semi-cylindrical configuration which extends linearly along the outer peripheral edge 14 of an associated table 18 when the device 10 is coupled thereto as shown in FIG. 2 of the drawings. The semi-cylindrical member 28 includes a planar inner surface which abuttingly engages the outer peripheral edge 14 of the table 18.

As shown in FIG. 6, a first form of the coupling means 24 comprises a connecting element 30 extending from a lower edge of the semi-cylindrical member 28 as viewed within FIG. 6 and projecting substantially orthogonally from the planar interior surface thereof. An interior flange 32 projects substantially orthogonally from the connecting element 30 and cooperates with the semi-cylindrical member 28 so as to define an unlabeled receiving space within which the depending flange 26 can be positioned. A fastener 34 is directed through the interior flange 32 and can be axially advanced into engagement with the depending flange 26 so as to capture the depending flange between the semi-cylindrical member 28 and the fastener 34 to secure the linear bumper member 12 relative to the table 18.

As shown in FIG. 7, the interior flange 32, in lieu of the fastener 34 directed therethrough, may alternatively extend from the connecting element 30 at an oblique angle so as to extend into contact with the planar interior surface of the semi-cylindrical member 28. In this alternative form of the coupling means 24 illustrated in FIG. 7, the linear bumper member 12 is constructed of a substantially resilient material permitting an outward deformation of the interior flange 32 from the planar interior surface of the semi-cylindrical member 28 such that the depending flange 26 can be positioned therebetween, whereby a releasing of the interior flange 32 will result in a resilient contraction of the interior flange towards the planar interior surface of the semi-cylindrical member 28 so as to frictionally capture the depending flange 26 therebetween to secure the linear bumper 12 relative to the table 18. By either structure of the coupling means 24, the linear bumper member 12 can be easily coupled to the depending flange 26 of an associated table 18.

Figure 4:
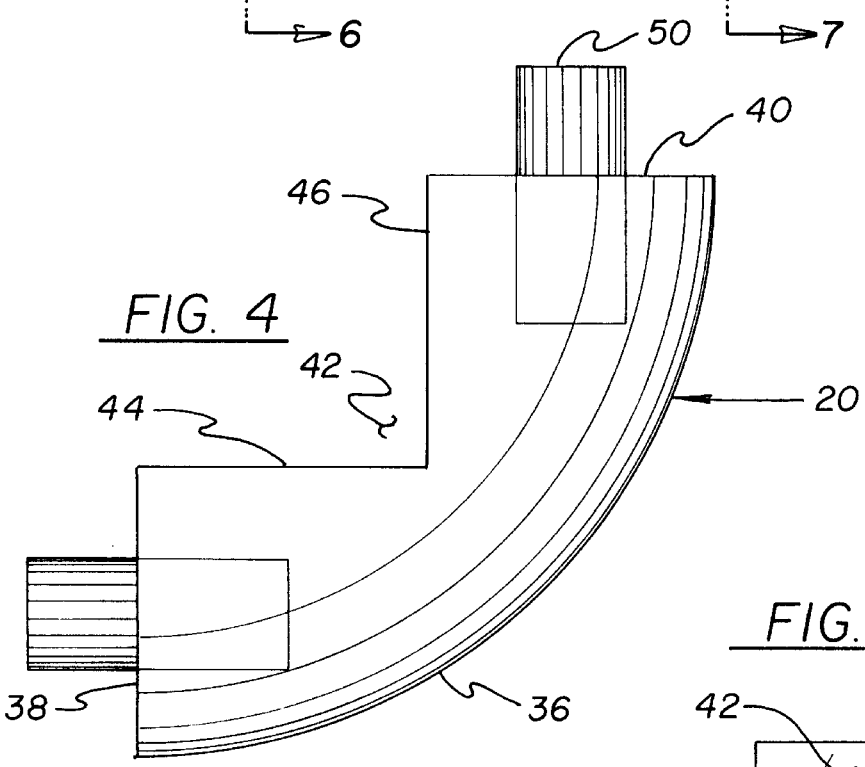
FIG. 4 is an enlarged top plan view of a corner bumper member of the invention.
Figure 5:
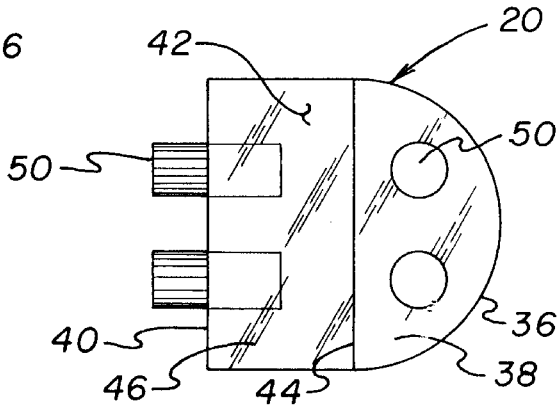
FIG. 5 is an end elevation view of a corner bumper member.

Referring now to FIGS. 4 and 5 with concurrent reference to FIGS. 6 and 7, it can be shown that the corner bumper member 20 of the present invention 10 preferably comprises a quarter-circle member 36 having an unlabeled outer arcuate edge extending through an arc of approximately ninety degrees. The quarter-circle member 36 is shaped so as to define a first end wall 38 extending substantially orthogonally from an exterior tangent of the quarter-circle member 36 at a first end of the corner bumper member 20. Similarly, a second end wall 40 extends substantially orthogonally from an exterior tangent of the quarter-circle member 36 at a second end thereof so as to project in a substantially orthogonal orientation relative to the first end wall 38 as the outer arcuate edge of the quarter-circle member 36 extends through the arc of approximately ninety degree. Further, the quarter-circle member 36 is shaped so as to define a right-angled recess 42 directed medially into the quarter-circle member and defining a first recess wall 44 extending substantially orthogonally from the first end wall 38. Further, the right-angled recess 42 defines a second recess wall 46 extending substantially orthogonally relative to the second end wall 40. Preferably, the first end wall 38 and the second end wall 40 are of a transverse width equal to a transverse width of the semi-cylindrical member 28 as viewed within FIG. 6 and 7 of the drawings. By this structure, either end wall 38 or 40 of the corner bumper member 20 can be positioned into an abutting relationship with an end of the linear bumper member 12 so as to define a continuous exterior surface of the device 10 extending about an orthogonal corner 22 of the table top 16 when the device 10 is coupled thereto as shown in FIG. 2 of the drawings.

To secure the corner bumper 20 to an adjacent linear bumper member 12, the linear bumper is shaped so as to define at least one mounting aperture 48 extending longitudinally therethrough. The corner bumper member 20 is provided with at least one mounting projection 50 extending from each of the end walls 38 and 40 and configured for reception within the mounting aperture 48 of the linear bumper member 12. Preferably, the corner bumper member 20 includes a pair of spaced mounting projections 50 which are cooperatively received within a pair of spaced mounting apertures 48 directed through the semi-cylindrical member 28 of the linear bumper member 12. By this structure, the linear bumper member 12 can be cut to a desired length so as to extend proximal to and between adjacent corners 22 of the table top 16. The corner bumper member 20 can thus be coupled to the linear bumper member 12 through an insertion of the mounting projection 50 into the mounting apertures 48 of the linear bumper member 12. Thus, because the mounting apertures 48 extending completely through the semi-cylindrical member 28 of the linear bumper member 12, the device 10 can be easily cut and customized to a particular length for a desired table 18.

The linear bumper 12 and the corner bumper member 20 are preferably formed of a substantially transparent and resilient material permitting use of the device as described above. The transparent nature of the material utilized in the construction of the present invention 10 allows for viewing of the outer edges 14 and corners 22 of the table top 16 such that the device 10 goes unnoticed when in use. The present invention 10 is preferably provided with a plurality of linear bumper members 12 and a plurality of corner bumper members 20 such that an outer circumference of a table top 16 of a table 18 can be completely enclosed as shown in FIG. 2 of the drawings.

In use, the table edge bumper assembly 10 of the present invention can be easily utilized for coupling to outer peripheral edges 14 and corners 22 of an associated table 18 so as to preclude damage to the table and/or injury to individuals contacting such table 18.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A table edge bumper assembly comprising:

a linear bumper member securable to a linear outer peripheral edge of a table top of a table, the linear bumper member comprises a coupling means extending therefrom for engaging a depending flange extending about the table top of the table; and a semi-cylindrical member extending from the coupling means and including an arcuate exterior surface of semi-cylindrical configuration which extends linearly along a longitudinal length of the linear bumper member, the semi-cylindrical member including a planar inner surface which can abuttingly engage the outer peripheral edge of the table, the coupling means comprises a connecting element extending from a lower edge of the semi-cylindrical member; an interior flange projecting from the connecting element and cooperating with the semi-cylindrical member so as to define a receiving space within which the depending flange of the table top can be positioned; and a fastener directed through the interior flange which can be axially advanced into engagement with the depending flange so as to capture the depending flange between the semi-cylindrical member and the fastener to secure the linear bumper member relative to the table;

a corner bumper member removably coupled to the linear bumper member for covering a corner of the table top.

2. The table edge bumper assembly of claim 1, wherein the corner bumper member comprises a quarter-circle member having an outer arcuate edge extending through an arc of approximately ninety degrees, the quarter-circle member being shaped so as to define a first end wall extending substantially orthogonally from an exterior tangent of the quarter-circle member at a first end of the corner bumper member, and a second end wall extending substantially orthogonally from an exterior tangent of the quarter-circle member at a second end thereof so as to project in a substantially orthogonal orientation relative to the first end wall, the quarter-circle member being further shaped so as to define a right-angled recess directed medially into the quarter-circle member and defining a first recess wall extending substantially orthogonally from the first end wall, and a second recess wall extending substantially orthogonally relative to the second end wall.

3. The table edge bumper assembly of claim 2, wherein the first end wall and the second end wall are of a transverse width equal to a transverse width of the semi-cylindrical member.

4. The table edge bumper assembly of Claim 3, wherein the linear bumper member is shaped so as to define at least one mounting aperture extending longitudinally therethrough, with the corner bumper member including at least one mounting projection extending from each of the end walls, the mounting projection being configured for reception within the mounting aperture of the linear bumper member.

5. The table edge bumper assembly of Claim 4, wherein the linear bumper member is shaped so as to define a pair of spaced mounting apertures directed longitudinally through the semi-cylindrical member, and the corner bumper member, includes a pair of spaced mounting projections such that relative rotation of the linear bumper member and the corner bumper member is precluded.

6. The table edge bumper assembly of Claim 5, wherein the linear bumper member and the corner bumper member are formed of a substantially transparent and resilient material.

7. A table edge bumper assembly comprising:

a table having a table top, the table top including a depending flange defining a linear outer peripheral edge having at least one corner;

a linear bumper member secured to the linear outer peripheral edge of the table top of the table, the linear bumper member comprises a coupling means extending therefrom for engaging the depending flange extending about the table top of the table; and a semi-cylindrical member extending from the coupling means and including an arcuate exterior surface of semi-cylindrical configuration which extends linearly along a longitudinal length of the linear bumper member, the semi-cylindrical member including a planar inner surface which can abuttingly engage the outer peripheral edge of the table, the coupling means comprises a connecting element extending from a lower edge of the semi-cylindrical member; an interior flange projecting from the connecting element and cooperating with the semi-cylindrical member so as to define a receiving space-within which the depending flange of the table top can be positioned; and a fastener directed through the interior flange which can be axially advanced into engagement with the depending flange so as to capture the depending flange between the semi-cylindrical member and the fastener to secure the linear bumper member relative to the table;

a corner bumper member removably coupled to the linear bumper member and positioned over the corner of the table top.

8. The table edge bumper assembly of Claim 7, wherein the corner bumper member comprises a quarter-circle member having an outer arcuate edge extending through an arc of approximately ninety degrees, the quarter-circle member being shaped so as to define a first end wall extending substantially orthogonally from an exterior tangent of the quarter-circle member at a first end of the corner bumper member, and a second end wall extending substantially orthogonally from an exterior tangent of the quarter-circle member at a second end thereof so as to project in a substantially orthogonal orientation relative to the first end wall, the quarter-circle member being further shaped so as to define a right-angled recess directed medially into the quarter-circle member and defining a first recess wall extending substantially orthogonally from the first end wall, and a second recess wall extending substantially orthogonally relative to the second end wall.

9. The table edge bumper assembly of Claim 8, wherein the first end wall and the second end wall are of a transverse width equal to a transverse width of the semi-cylindrical member.

10. The table edge bumper assembly of Claim 9, wherein the linear bumper member is shaped so as to define at least one mounting aperture extending longitudinally therethrough, with the corner bumper member including at least one mounting projection extending from each of the end walls, the mounting projection being configured for reception within the mounting aperture of the linear bumper member.

11. The table edge bumper assembly of Claim 10, wherein the linear bumper member is shaped so as to define a pair of spaced mounting apertures directed longitudinally through the semi-cylindrical member, and the corner bumper member includes a pair of spaced mounting projections such that relative rotation of the linear bumper member and the corner bumper is precluded.

12. The table edge bumper assembly of Claim 11, wherein the linear bumper member and the corner bumper member are formed of a substantially transparent and resilient material.

* * * * *